US005820357A

United States Patent [19]

Itoh

[11] Patent Number: 5,820,357

[45] Date of Patent: Oct. 13, 1998

[54] ENCLOSED TYPE ROTARY COMPRESSOR

[75] Inventor: Hiroshi Itoh, Takefu, Japan

[73] Assignee: Matsushita Electric Industrial Co., Ltd., Japan

[21] Appl. No.: 727,082

[22] Filed: Oct. 8, 1996

[30] Foreign Application Priority Data

Oct. 16, 1995 [JP] Japan ..... 7-266717

[51] Int. Cl.[6] ..... F04B 35/04

[52] U.S. Cl. ..... 417/410.3; 418/151

[58] Field of Search ..... 417/410.3, 907; 418/151

[56] References Cited

U.S. PATENT DOCUMENTS 2,200,222 5/1940 Tarleton ..... 417/410.3
3,850,551 11/1974 Gamache et al. ..... 417/410.3
4,568,253 2/1986 Wood ..... 417/410.3

FOREIGN PATENT DOCUMENTS 57-159360 10/1982 Japan .

*Primary Examiner*—Charles G. Freay
*Attorney, Agent, or Firm*—Parkhurst & Wendel

[57] ABSTRACT

An inexpensive enclosed type rotary compressor capable of diminishing vibration. A balance weight is split into two parts. A first balance weight is formed by die casting, forging, sintering or the like to be in such a form that its end portions each having a hole for accommodating by a fixing protrusion are thinner than the remaining portion, and a second balance weight is formed as a single plate or laminated plates in plural layers and securedly sandwiched between the end ring of a rotator and the first balance weight. As a result, the balance weight can be standardized, realizing cost efficiency.

2 Claims, 3 Drawing Sheets

PRIOR ART

PRIOR ART

ENCLOSED TYPE ROTARY COMPRESSOR

FIELD OF THE INVENTION

The present invention relates to an enclosed type rotary compressor for use in an air conditioner, a refrigerator or the like.

BACKGROUND OF THE INVENTION

Generally, a conventional enclosed type rotary compressor includes a balance weight disposed on the end ring of a rotator of a motor element, with the purpose of correcting unbalance and minimizing vibration of a compressor element.

FIG. 3 shows a longitudinal section of a rotary type enclosed rotary compressor. In the figure, reference numeral 1 denotes an enclosed container, 2 a motor element, 3 a stator, 4 a rotator, 5 a shaft, 6 a compressor element, 7 a roller, 8 a cylinder chamber, 9 an end ring, and each 10 and 11 a balance weight.

FIG. 4 is a partial perspective view of a conventional rotator. The balance weight 10 is securedly fixed on fixing protrusions 12 which are formed integrally with the end ring 9. The amount of unbalance of the compressor element 6 varies depending on the size of the compressor element 6, that is, for example, according as the dimensions of the cylinder chamber 8 changes. In order to correct such unbalance of the compressor element 6, the size of the balance weight 10, 11 to be secured onto the end ring 9 of the rotator 4 of the motor element 2 needs be changed.

Since the balance weight 10, 11 is formed by such process as die casting, forging or sintering, in order to change the size of the balance weight 10, 11 in correspondence to the amount of unbalance of the compressor element 6, it is necessary to produce many kinds of mold to form a balance weight of the best fit size in each case, which is very costly. If there are ten compressor elements 6 which are different one another in size, in order to minimize vibration caused by the unbalance of the compressor element 6, it is ideal to produce ten different balance weights 10, 11 in correspondence to the compressor elements 6. However, the mold for forming a balance weight is so expensive that, in reality, five to seven molds, fewer than ten, are produced at the sacrifice of minimizing the vibration. Therefore, a balance weight which is most approximate to the best fit is chosen among others and fixed in a compressor element.

Further, there was another attempt to solve the problem, that was, to stamp out thin plates in a certain form by press forming, laminate the stamped out thin plates in plural layers, and fix the laminated thin plates on the end ring 9, in the same manner as a balance weight 103 shown in FIG. 5. However, compared with the fixing protrusion 12 for fixing the balance weight 10 as shown in FIG. 4, the fixing protrusion 12 of the end ring 9 shown in FIG. 5 needs be made longer in length. Since the end ring 9 and the fixing protrusion 12 are integrally formed by die casting, if the fixing protrusion 12 needs be longer, short filling threatens to occur, weakening the strength of the fixing protrusion 12. This posed another problem that the fixing protrusion 12 threatens to be broken by centrifugal force and the balance weight 103 is caused to get out of place.

DISCLOSURE OF THE INVENTION

The object of the present invention is to solve the above problems and to provide an inexpensive enclosed type rotary compressor which vibrates little.

In order to achieve the object, the enclosed type rotary compressor according to the invention is devised to have its balance weight divided into a first balance weight which is composed of one balance weight and a second balance weight which is composed of one or more weights. With the second balance weight, total weight of the entire balance weight can easily be adjusted, and it is unnecessary to produce so many balance-weight-forming molds as to correspond to each various compressor elements different in size. By simply changing the number of weights, the second balance weight can be well adjusted to correspond to any compressor element of any size. As a result, the balance weight can be standardized and provided at a reasonable price.

Moreover, according to the enclosed type rotary compressor of the invention, the first balance weight is produced by die casting, forging, sintering or the like, such that the fixing portion formed with a hole to be inserted by the fixing protrusion of the end ring is formed to be thinner than the other portion, and the second balance weight is composed of one or more weights formed as a thin plate and is disposed between the end ring and the first balance weight. In this way, the fixing portion is formed to be thinner than the other portion so that the fixing protrusion of the end ring can be shortened, whereby no short filling threatens to occur in the fixing protrusion while the end ring and the fixing protrusion are being formed integrally by die casting. As a result, neither the strength of the fixing protrusion decreases nor the fixing protrusion breaks due to centrifugal force, whereby the balance weight is free from getting out of place.

PREFERRED EMBODIMENT

Figure 1:
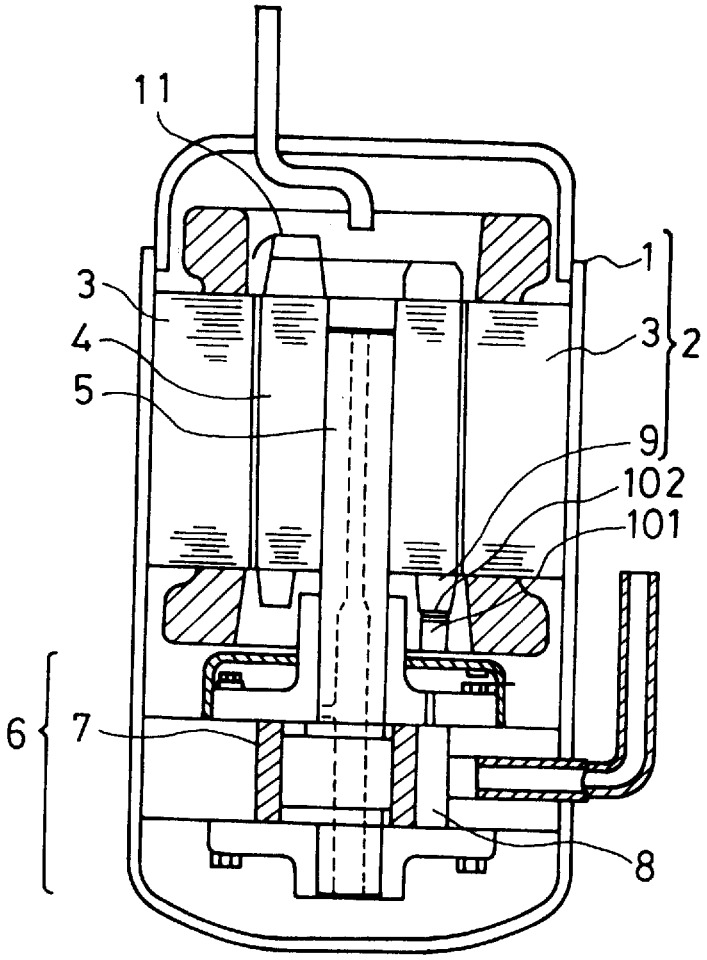
FIG. 1 is a longitudinal sectional view of an enclosed type rotary compressor according to an embodiment of the invention.
Figure 2:
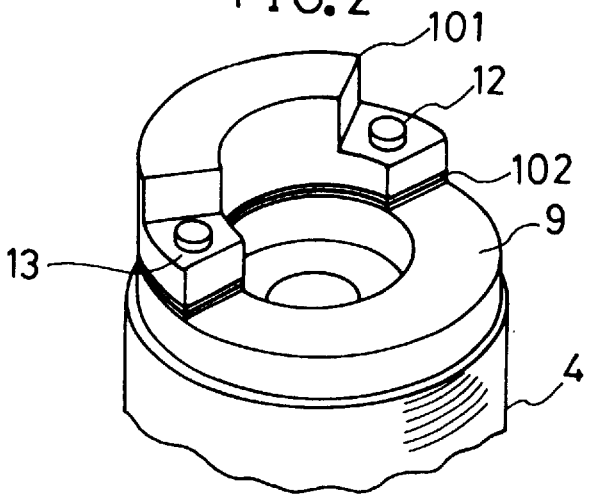
FIG. 2 is a partial perspective view of a rotator of the enclosed type rotary compressor according to the embodiment of the invention.
Figure 3:
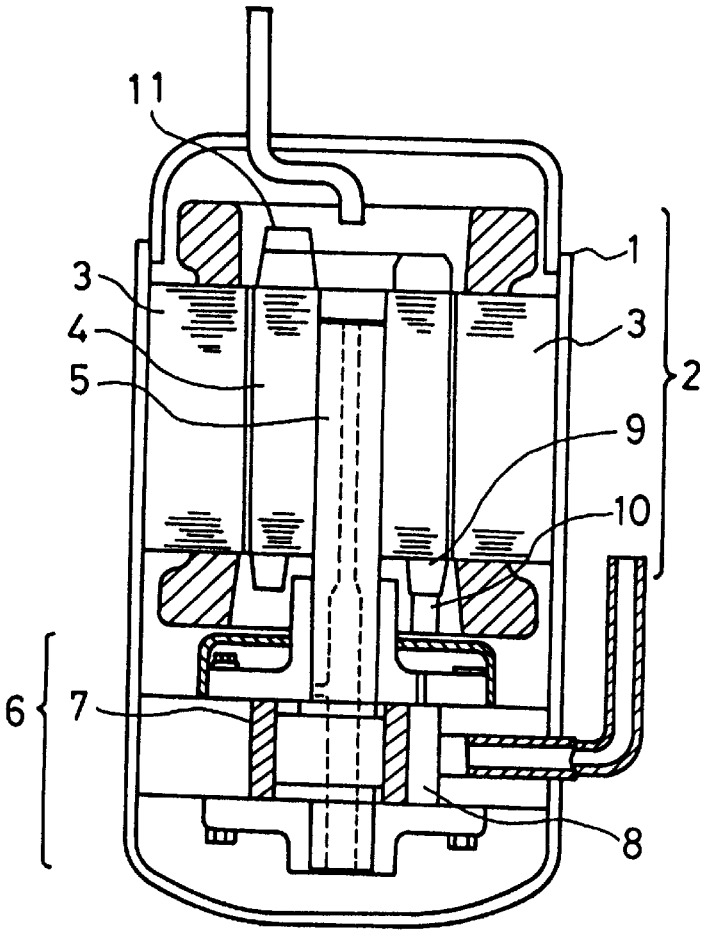
FIG. 3 is a longitudinal sectional view of a conventional enclosed type rotary compressor.
Figure 4:
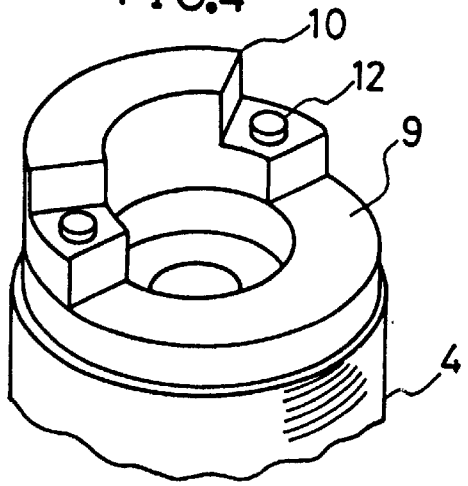
PRIOR ART FIG.4
FIG. 4 is a partial perspective view of a conventional rotator.
Figure 5:
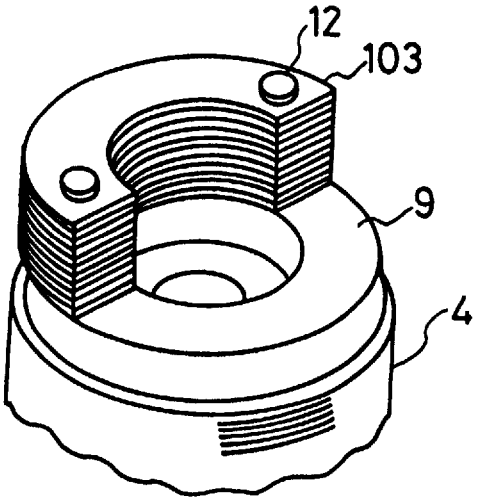
FIG. 5 is a partial perspective view of another conventional rotator.

Hereinafter, an embodiment of the invention will be explained with reference to the drawings.

FIG. I is a longitudinal sectional view of an enclosed type rotary compressor according to one embodiment of the invention.

According to the invention, such components as an enclosed container 1, a motor element 2, a stator 3 and a rotator 4 are the same as conventional ones, The balance weight of the invention comprises a first balance weight 101 formed in one body and a second balance weight 102 composed of one or more thin plates. These balance weights 101, 102 are securedly fixed on an end ring 9 by means of fixing protrusions 12.

The first balance weight is integrally formed by die casting, forging, sintering or the like to be in a C-shaped form on the whole, and fixing portions 13 at both end portions are formed to be thinner than the remaining portion and formed with holes to be inserted by the fixing protrusions 12.

The second balance weight 102 is produced by press forming to stamp out one or more thin plates in a C-shaped form, which are then formed with holes to be inserted by the fixing protrusions 12. One or more plates of this second balance weight are securedly sandwiched between the end ring 9 and the first balance weight 101.

As described above, the balance weight of the invention is divided into the first and the second balance weights. In the first balance weight 101 which is produced by die casting, forging, sintering or the like, the fixing portions 13 formed with holes to be inserted by the fixing protrusions 12 are made to be thinner than the remaining portion, whereby the fixing protrusions 12 for fixing the balance weight need not be made extra longer. As a result, the fixing protrusions 12 do not threaten to break while being subjected to centrifugal force and therefore the balance weight is free from getting out of place.

Further, since the second balance weight 102 is produced by press forming to stamp out one or more thin plates as its weight and is securedly sandwiched between the end ring 9 and the first balance weight 101, the total weight of the entire balance weight can be easily adjusted by varying the number of weight plates of the second balance weight and, in addition, it is unnecessary to produce a lot of balance-weight-forming molds in correspondence to the various compressor elements 6 which are different one another in size.

What is to be claimed is:

1. An enclosed type rotary compressor, comprising:

an enclosed container accommodating a motor element and a compressor element, said motor element including a rotator having an end ring having a fixing protrusion integrally formed therewith, and a balance weight securedly fixed to said end ring via said fixing protrusion, wherein said balance weight comprises (i) a first balance weight comprising a single body having a fixing portion thinner than the remaining portion of said first balance weight and defining a hole for receiving said fixing protrusion and (ii) a second balance weight comprising at least one plate, said at least one plate being substantially thinner than said fixing portion of said first balance weight, said second balance weight being sandwiched between said end ring and said first balance weight.

2. The compressor of claim 1, wherein said first balance weight is one of die cast, forged and sintered.

* * * * *